US005814781A

United States Patent [19]

Koyanagi et al.

[11] Patent Number: 5,814,781

[45] Date of Patent: Sep. 29, 1998

[54] PUFFER TYPE GAS CIRCUIT BREAKER

[75] Inventors: Osamu Koyanagi, Hitachi; Kastuichi Kashimura, Takahagi; Yoshihito Asai, Hitachi; Yukio Kurosawa, Hitachi; Goro Daimon, Hitachi; Kenji Tsuchiya, Hitachi; Eisaku Mizufune, Hitachi; Kogi Ishikawa, Mito, all of Japan

[73] Assignee: Hitachi, Ltd., Tokyo, Japan

[21] Appl. No.: 594,491

[22] Filed: Jan. 31, 1996

[30] Foreign Application Priority Data

Feb. 3, 1995 [JP] Japan ..... 7-016658

[51] Int. Cl.[6] ..... H01H 33/88

[52] U.S. Cl. ..... 218/60; 218/78

[58] Field of Search ..... 218/43, 46, 48, 218/50, 51, 56, 57, 59–63, 65, 68, 74, 76, 78, 84

[56] References Cited

U.S. PATENT DOCUMENTS 4,211,904 7/1980 Karrenbauer ..... 200/148 A
4,412,115 10/1983 Okuno ..... 200/148 A
4,459,447 7/1984 Arimoto ..... 200/148 A

FOREIGN PATENT DOCUMENTS 58-26133 6/1983 Japan ..... H01H 33/91

*Primary Examiner*—Michael L. Gellner
*Assistant Examiner*—Michael A. Friedhofer
*Attorney, Agent, or Firm*—Fay, Sharpe, Beall, Fagan, Minnich & McKee

[57] ABSTRACT

A puffer type gas-blast circuit breaker includes a guide section arranged at a coupler section between a shaft section of a puffer cylinder and a dielectric operating rod, for guiding both in the axis direction of a current interruption section and in the radial direction thereof, thereby to suppress or eliminate the occurrence of misalignment of center axis between movable components and fixed ones thus causing a gap to remain constant between a dielectric nozzle and a fixed arc contact. With such an arrangement, the gap between the nozzle and the contact can be kept uniform even when the pole-to-pole distance is increased with an increase in the high withstanding voltage of the breaker. This ensures that the surface-creeping electric field on the inner surface of the dielectric nozzle can be at a desired design value, thus enabling to provide a stable pole-to-pole insulation characteristic during current interruption operations.

4 Claims, 6 Drawing Sheets

PUFFER TYPE GAS CIRCUIT BREAKER

BACKGROUND OF THE INVENTION

The present invention relates generally to gas-blast circuit breakers of puffer type, and more particularly to puffer type gas circuit breakers for improvements in high-voltage characteristics and mechanical reliability at current-flow interruption sections thereof.

Recently, as power systems require higher voltages, the circuit breakers adopted therein become more critical in achievement of a further increased high-voltage characteristics by improving the current interruption performance of them. At present, puffer type gas circuit breakers are becoming more widely used in the power systems as high-voltage circuit breakers employing an arc-extinctive gas, such as $SF_6$, which is excellent in dielectricity and extinction-of-arc performance. To further improve the high-voltage characteristics of such puffer type gas circuit breakers, it is required that the breakers should be enhanced in the pole-to-pole insulation performance during current interruption operations, as well as in the open states of the current interruption (or cut-off) sections. In addition, it will also be an important subject to be solved that the mechanical reliability should be attained upon the application of operating forces, which increase with an increase in the high-voltage characteristics.

FIG. 10 illustrates a cross-section of a current interruption section adopted in a puffer type gas circuit breaker in the prior art. Note that the operating state illustrated in FIG. 10 corresponds to the end region of one cycle of current interruption or cut-off operations. An envelop 1 is filled with a chosen arc-extinctive gas. A puffer cylinder 2 consists of a cylinder section 2*a* and a shaft section 2*b*. A movable arc contactor (contact) 3 and a dielectric nozzle 4 may be either formed integrally with the puffer cylinder 2 or fixed together thereto in such a manner that the puffer cylinder 2 and a fixed piston 5 constitute a puffer chamber 6, which acts as a pressure generation section. The movable arc contact 3 is also connected electrically to a main current-carrying bus conductor 9 by way of several components including the fixed piston 5, fixed to the envelop 1 via a dielectric tube member 7, and a connector section 8. On the other hand, the fixed arc contact 10 is fixed to a tubular exhaust pipe 11, which in turn is secured to the envelop 1 through a dielectric tube member 12. The fixed arc contact 10 is electrically coupled to another main bus conductor 14 via the exhaust pipe 11, a connector 13 and others. The puffer cylinder 2 may be externally driven by a known operation control device (not shown) provided outside the envelop 1 by way of a dielectric operating rod 18, which is mechanically coupled at a coupler section 15 by using pins 16, 17. Numerals "19" and "20" designate current-carrying contacts, whereas "2*c*", "5*a*" and "11*a*" indicate gas exhaust ports. Note that, in FIG. 10, arrows are employed to represent the flow of gas as caused during current interruption operations.

During the current interruption operations, when the puffer cylinder 2 is driven to move in the right-hand direction of the illustration of FIG. 10 by the external operation controller (not shown) through the dielectric operating rod 18, the gas inside the puffer chamber 6 is then compressed. With the occurrence of such compression, an arc ignition appears between the movable arc contact 3 and the fixed arc contact 10 opposed thereto. The arc extinctive gas as compressed within the puffer chamber 6 is sprayed at high speeds against the arc ignited causing it to be extinguished.

The gas sprayed at high speeds is then exhausted in the opposite directions: one direction on the side of the fixed arc contact 10, and the other direction on the side of the movable arc contact 3 from hollow sections through the exhaust ports 2*c*, 5*a*. High-temperature gas exhausted on the side of the fixed arc contact 10 is finally released out of the inside space of the tubular exhaust pipe 11 via the exhaust port 11*a*.

Note here that the leading small-current interruption performance serves as one of the strict requirements for the puffer type gas circuit breakers during the current interruption under the demand for achievement of higher withstanding voltages. As one example of the presently available performance-enhancing techniques is disclosed, for example, in Japanese Patent Publication No. 58-26133. With the prior art, the flow of current may be interrupted or cut off even just after the occurrence of pole open of an arc contact due to the fact that the interruption condition adopted therein renders the cut-off current smaller and also causes the recovery voltage of commercial frequency as applied between poles after the termination of current interruption to be lowered in the rate of rise. This ensures that higher recovery voltage can be applied with the pole-to-pole distance shorter than ever. The prior art disclosed in Japanese Patent Publication No. 58-26133 attempts to improve the insulation performance by making use of the following arrangements: the diameter of the fixed arc contact 10 is variable in a step-like manner, during the initial region of one current-interruption cycle, a gap defined between the dielectric nozzle 4 and the fixed arc contact 10 is forced to remain smaller to thereby suppress or eliminate the occurrence of extra consumption of an arc-extinctive gas to be exhausted from the dielectric nozzle 4 through the gap toward the direction on the side of the fixed arc contact 10, and during the intermediate region in the cycle where a relatively high voltage is applied between the poles, the gap is rendered larger causing the surface-creeping electric field to decrease on the inner surface of the dielectric nozzle 4 whereby the dielectricity can be enhanced. However, in order to accomplish further increased high-voltage characteristics of the current interruption section and stable dielectricity, the prior art suffers from a problem as described below.

FIG. 11 shows a partial cross-section of the current interruption section during the intermediate region of one current interruption cycle in the prior art. It is required that the pole-to-pole distance should be increased to maintain the dielectricity between these poles in the open-pole state and also to meet the demand of a further increase in the high-voltage characteristics. More specifically, this may cause several movable components, including the puffer cylinder 2, the movable arc contact 3, the dielectric nozzle 4 and the like, to increase in distance of movement accordingly. As such movement distance increases, variations may increase in center-axis alignment of some immovable or fixed components (such as the fixed arc contact 10, the fixed piston 5 and others) and the movable ones, depending upon the mechanical fabrication tolerance of slidable portions of the puffer cylinder 2 and the fixed piston 5. Due to this fact, as shown in FIG. 11, the gap g between the dielectric nozzle 4 and the fixed arc contact 10 is no longer uniform, with one side g1 of the gap smaller and the other g2 greater. As a result, as has been described in the previously mentioned Japanese Patent Publication No. 58-26133, an undesired phenomenon may take place wherein the surface electric field increases in intensity along the inner surface of the dielectric nozzle 4 at the portion where the smaller gap g1 is defined, while having a tip electric field also increased at the fixed arc contact 10, thus causing the pole-to-pole insulation performance to decrease. The gap g may vary for every cycle of the current interruption operations; if this is the case, since the electric field thereat may also vary accordingly, the pole-to-pole insulation performance becomes unstable during the current interruption operations.

Another important requirement is that the mechanical reliability should be maintained with respect to the application of an operating force which may increase with such further enhancement in the high-voltage characteristics. More specifically, an increase in deviations in the center axis between the movable components and the fixed ones may raise a serious problem regarding the mechanical reliability: scoring and/or abrasion happens as a result of an increased friction force at the sliding portions, and the dielectric nozzle 4 may be at least partly destroyed due to the occurrence of a contact between the dielectric nozzle 4 and the tip portion of fixed arc contact 10 when power is turned on.

SUMMARY OF THE INVENTION

The present invention is based on the observation as mentioned above, and an object of the invention is to provide a puffer type gas circuit breaker capable of ensuring the achievement of enhanced high-voltage characteristics of a current interruption section, the stability of insulation performance during current interruption operations, and the attainment of improved mechanical reliability.

In accordance with the instant invention, a specific guide section which provides all-directional guidance with respect to the operation axis of a current interruption section is arranged at the coupling section between a shaft section of a puffer cylinder and a dielectric operating rod in order to suppress or eliminate the occurrence of any misalignment of center axis between movable parts and fixed ones, by forcing the gap between the dielectric nozzle 4 and the fixed arc contact 10 to remain constant or uniform during current interruption operations.

With such an arrangement, maintaining uniform the gap between the dielectric nozzle and the fixed arc contact during the current interruption operations can cause both the surface-creeping electric field on the inner surface of the dielectric nozzle and the electric field created at the tip of the fixed arc contact to be at desired design values, thus enabling stable dielectric characteristics to be attained. Also, by preventing any center-axis misalignment from taking place between the movable and fixed components, it is possible to eliminate (i) the occurrence of scoring and/or abrasion originated from an increased friction force at their sliding portions and (ii) the occurrence of partial destruction of the dielectric-nozzle as a result of a contact between the dielectric nozzle and the tip portion of fixed arc contact when power is turned on.

Figure 1:
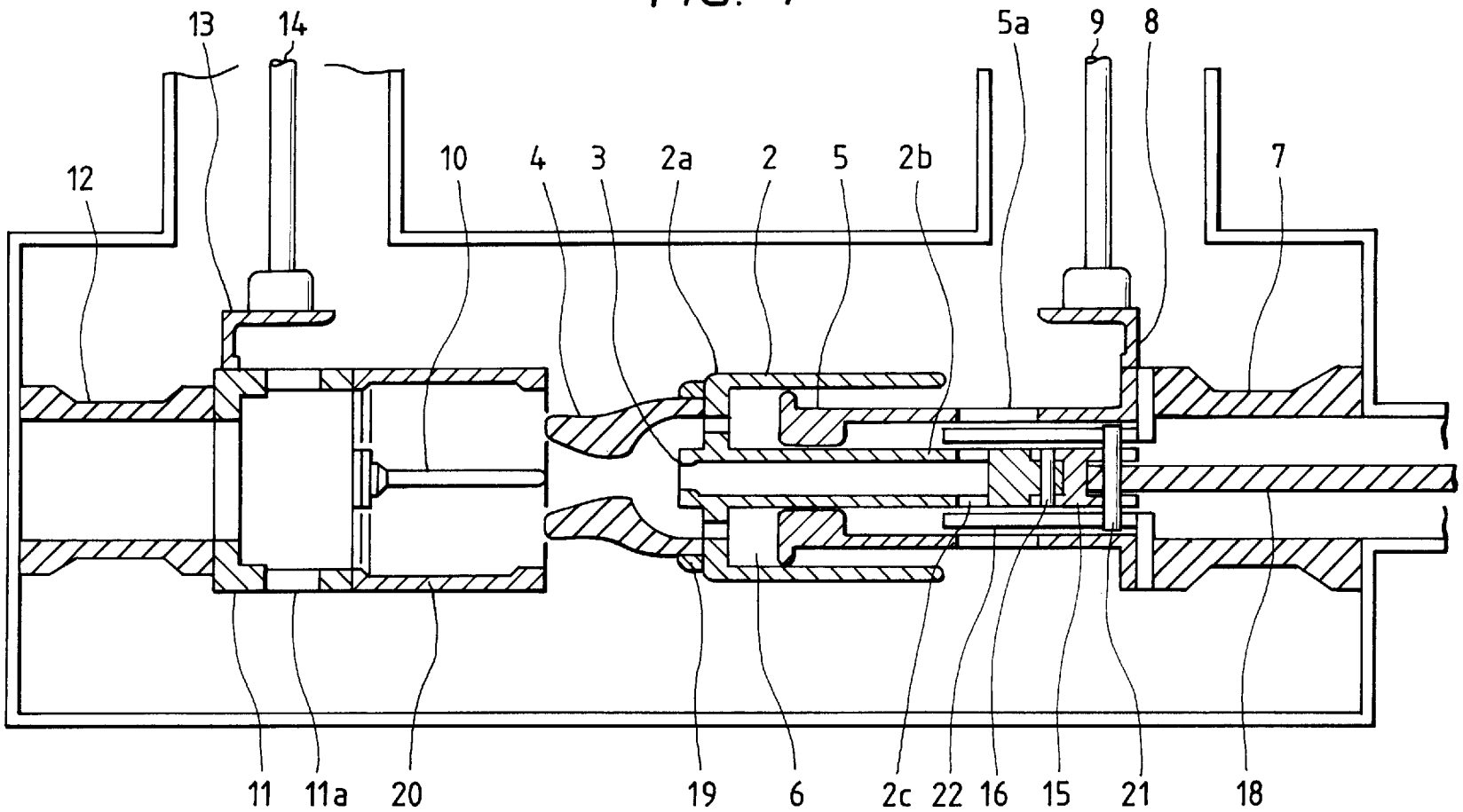
FIG. 1 illustrates a cross-section of a current interruption section of a puffer type gas-blast circuit breaker in accordance with one preferred embodiment of the invention.
Figure 10:
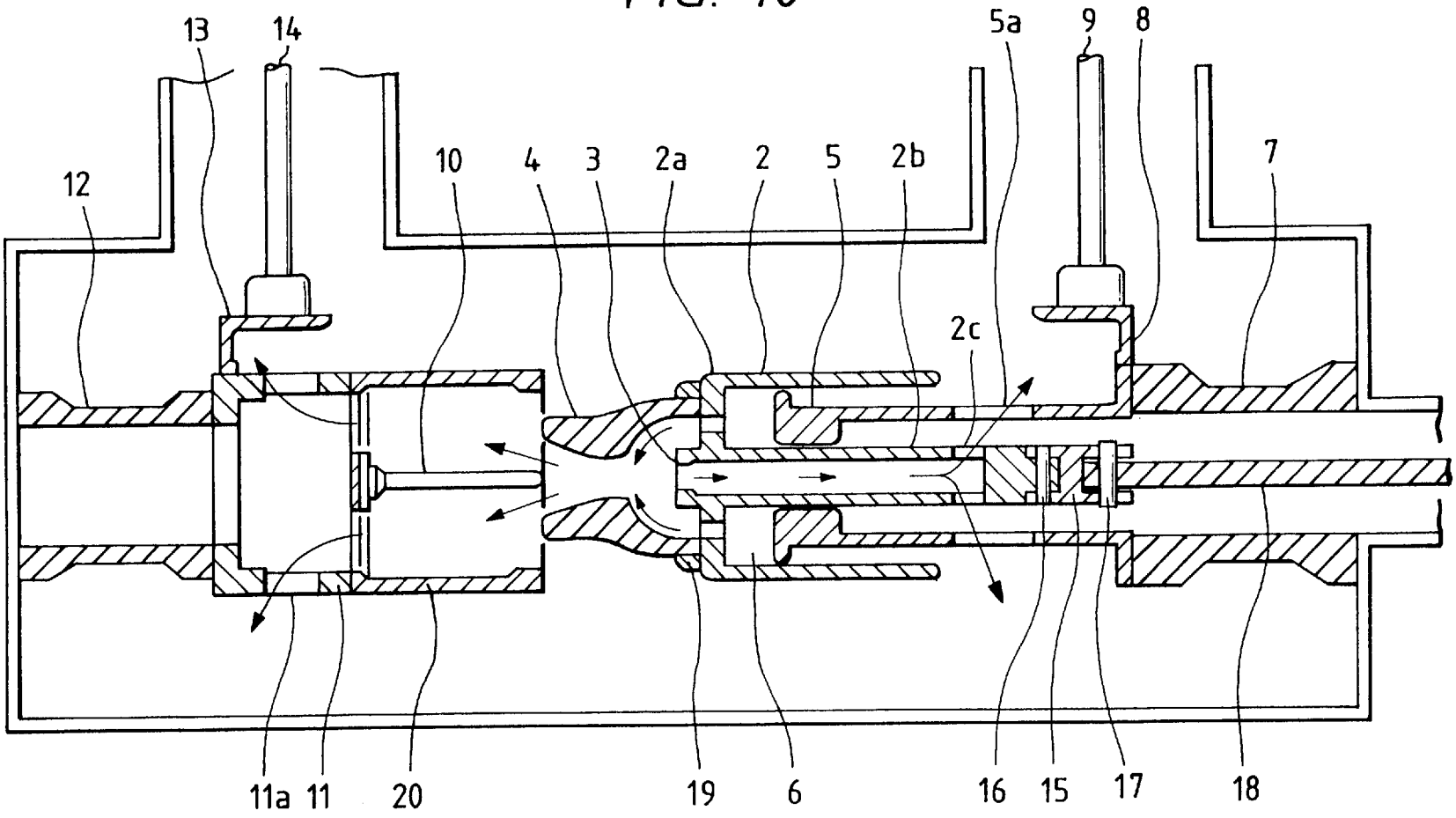
PRIOR ART FIG. 10
FIG. 10 illustrates a cross-section of a current interruption section of a puffer type gas circuit breaker in the prior art.
Figure 11:
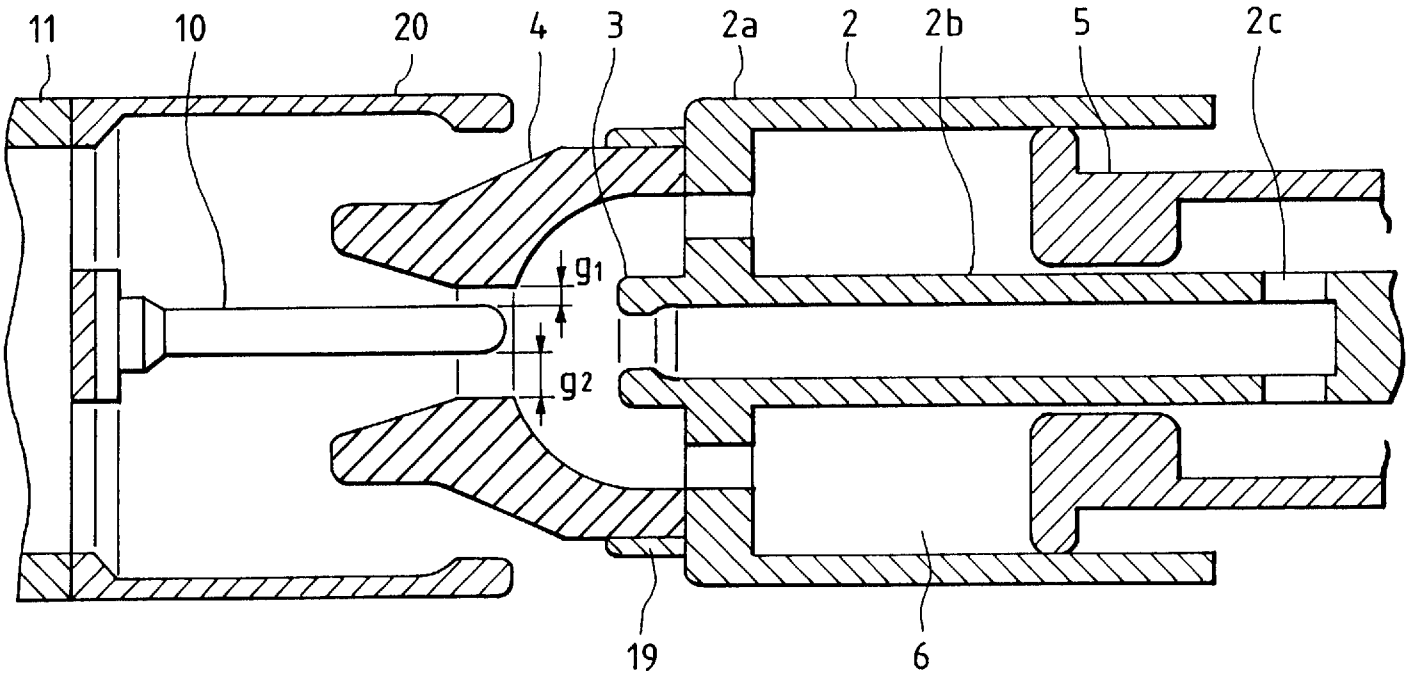
PRIOR ART FIG. 11
FIG. 11 shows a partial cross-section of a main section of the prior art of FIG. 10.

DETAILED DESCRIPTION OF THE PREFERRED EMBODIMENTS:

Referring to FIG. 1, a gas-blast circuit breaker of single pressure or puffer type embodying the invention is shown under an assumption that the circuit breaker is in the end state of one cycle of current interruption operations thereof. A significant difference of the breaker over the prior art shown in FIG. 10 is that a guide section 22 is specifically provided which includes a pair of parallel members for guiding a guide pin 21 coupling a coupler section 15 to a dielectric operating rod 18 in the axis direction of movable components, and for guiding the coupler section 15 along the axis direction of the guide pin 21 also.

Figure 2:
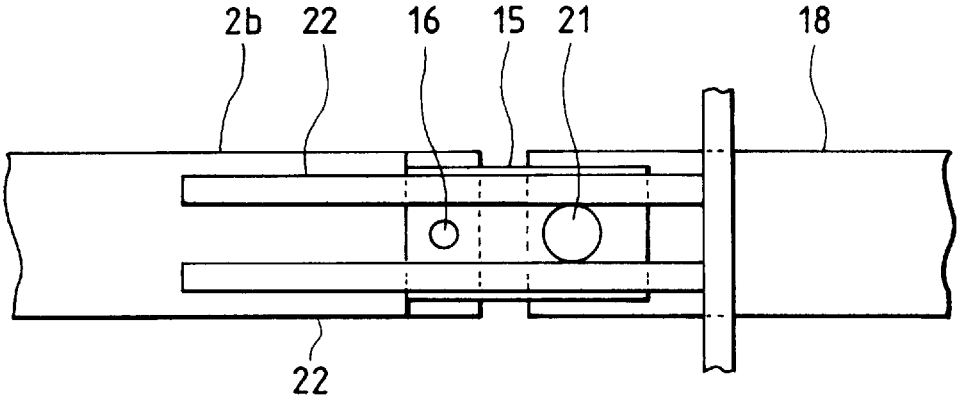
FIG. 2 is an enlarged partial plan view of the puffer type gas circuit breaker shown in FIG. 1.
Figure 3:
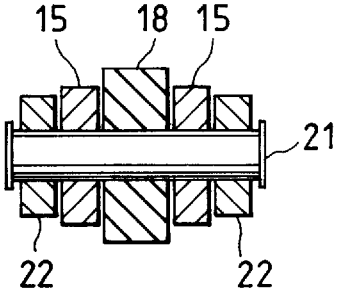
FIG. 3 shows a partial cross-section of a guide section adopted the circuit breaker shown in FIGS. 1 and 2.

A partial plan view of the guide section 22 of FIG. 1 is enlargedly illustrated in FIG. 2, while a cross-section of some parts associated with the guide pin 21 is shown in FIG. 3. The guide section 22 is fixed to an envelop 1 by a dielectric tube member 7, together with a fixed piston 5. As shown in the cross-section of FIG. 3, the coupler section 15 is arranged so that it cooperates with the guide section 22 to offer guidance in the axis direction of the guide pin 21, which corresponds to the radial direction of the center axis of operation.

With such an arrangement, it becomes possible to suppress or eliminate the occurrence of any center-axis misalignment between the movable components and the fixed ones of the puffer type gas circuit breaker, thus enabling a gap to remain uniform between the dielectric nozzle 4 and the fixed arc contactor (contact) 10. Furthermore, it is possible to minimize both the occurrence of scoring and/or abrasion originated from an increase in friction force at their sliding portions and the occurrence of destruction of the dielectric nozzle due to a contact between the dielectric nozzle 4 and the tip portion of fixed arc contact 10 when power is turned on.

Figure 4:
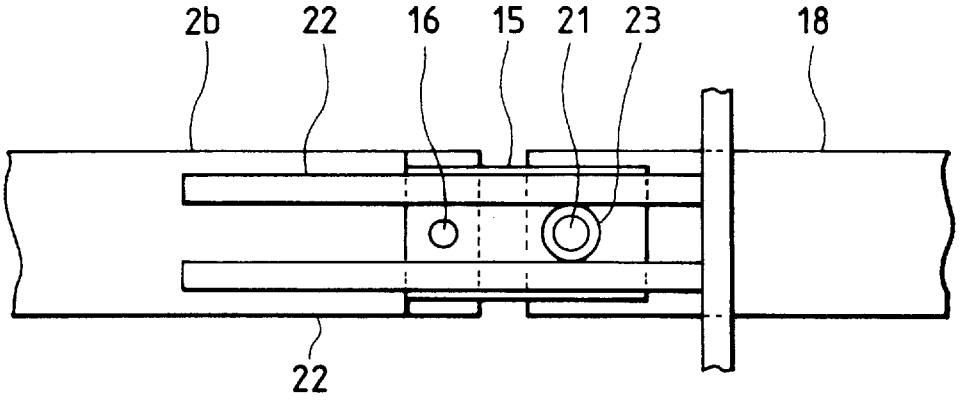
FIG. 4 shows an enlarged partial plan view of a puffer type gas circuit breaker in accordance with another embodiment of the invention.
Figure 5:
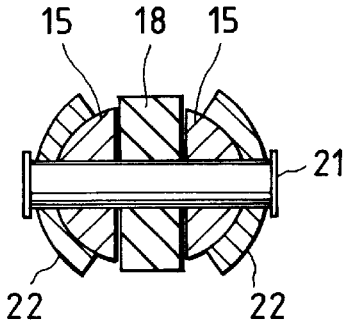
FIG. 5 is a partial cross-section of a guide section of a puffer type gas circuit breaker in accordance with a still another embodiment of the invention.

A guide section in accordance with another embodiment of the invention shown in FIG. 4 is similar to that of FIG. 2 with a rolling bearing 23 being added at the slidable portion between the guide pin 21 and the guide section 22. The bearing 23 may be a radial shaft, for example. Using such rolling bearing 23 for the slidable portion is advantageous in that scoring and/or abrasion can be prevented more successfully from taking place as a result of an increased friction force at the sliding portion, thus enabling more precise guidance. A still another embodiment of the invention is shown in FIG. 5, wherein the guide pin 21 thereof is illustrated in cross-section in a similar manner to that of the embodiment of FIG. 3. With the embodiment, the coupler section 15 is so formed as to exhibit a column-like outer peripheral surface as a whole, while the guide section 22 is arranged to guide both the outer peripheral surface and the guide pin 21. With such an arrangement also, there can be obtained substantially the same advantages as those of the embodiment shown in FIG. 3.

Figure 6:
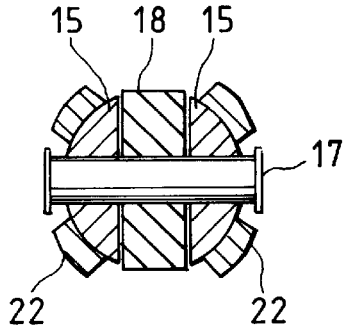
FIG. 6 shows a partial cross-section of a guide section of a puffer type gas circuit breaker in accordance with a further embodiment of the invention.

A yet another embodiment of the invention is shown in FIG. 6, wherein the coupler section 15 thereof is illustrated in cross-section in a similar manner to that of the embodiment of FIG. 3. With this embodiment, while the coupler section 15 is formed in a column-like outer peripheral surface as in the embodiment of FIG. 5, the guide section 22 is specifically arranged to guide such outer peripheral surface only. With the arrangement also, the radial guidance can be attained with respect to the operation axis of the current interruption section, thus minimizing the occurrence of downward variations in position due to the gravity in a similar manner to that of the embodiment of FIG. 3.

Figure 7:
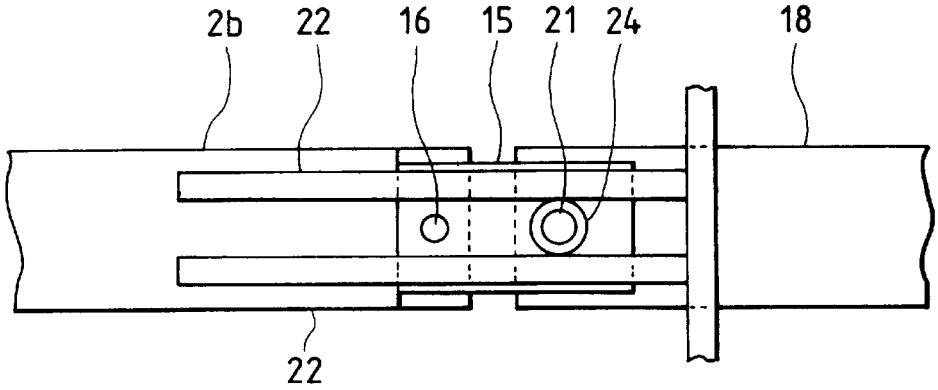
FIG. 7 shows an enlarged partial plan view of a puffer type gas circuit breaker in accordance with yet another embodiment of the invention.
Figure 8:
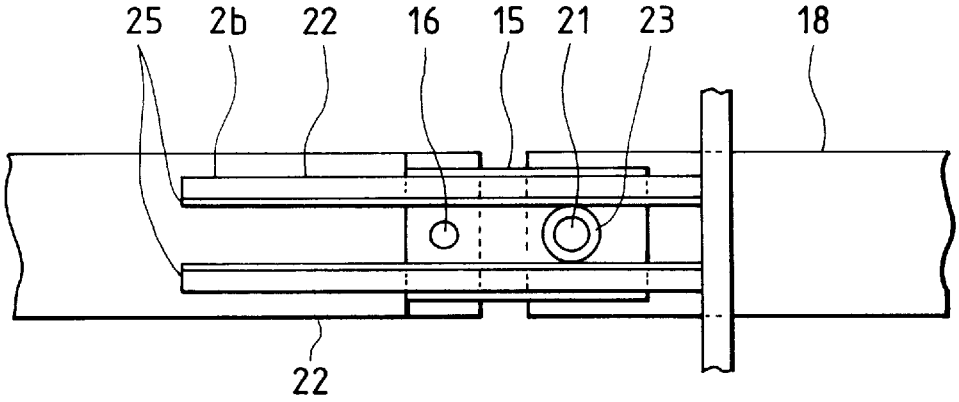
FIG. 8 is an enlarged partial plan view of a puffer type gas circuit breaker in accordance with a further embodiment of the inventions.
Figure 9:
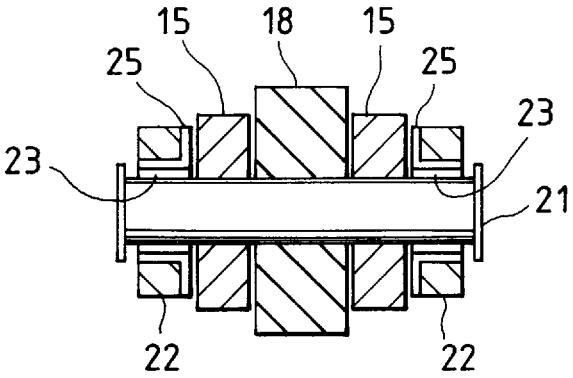
FIG. 9 is a partial cross-section of a guide section adopted in the circuit breaker shown in FIG. 8.

FIGS. 7, 8 and 9 show further embodiments of the invention, wherein the guide section 22 of each of FIGS. 7 and 8 is illustrated in cross-section corresponding to those of FIGS. 2 and 4, whereas the cross-section of the guide section 22 of FIG. 9 is illustrated in a similar manner to that of FIG. 3. With the embodiment of FIG. 7, the guide pin 21 is provided with a dielectric tube member 24 made of a chosen insulative material, thus forming a slidable portion between the guide section 22 and the dielectric tube 24. In the embodiment of FIG. 8, a dielectric plate 25 made of a chosen insulative material is arranged between the rolling bearing 23 adopted in the embodiment shown in FIG. 4 and the guide section 22. The cross-section of the guide pin 21 of FIG. 8 is illustrated in FIG. 9. With this embodiment, it is possible to prevent current, which may inherently flow from the shaft section 2*b* through the fixed piston 5 and the connector section 8 toward the main bus conductor 9 when interruption of current, from being diverted from the guide pin 21 via the slidable portions to the guide section 22 and the connector section 8. This is advantageous in that slidable portions can be protected against the occurrence of damages on the sliding surfaces thereof due to discharging. Note here that, in the previous embodiments shown in FIGS. 5 and 6 also, similar advantages may be obtained by adding such dielectric member at the slidable portions between the guide section 22 and the guide pin 21. This may alternatively be attained by modifying the guide section 22 so that this section itself is comprised of a suitable dielectric member.

In the embodiments previously set forth, the guide pin 21 is provided at the specific portion corresponding to the coupling pin 17 of the prior art of FIG. 10; alternatively, the guide pin 21 may be arranged at a position corresponding to the other coupling pin 16.

In accordance with the present invention, it is possible to maintain stability of the insulation performance during current interruption operations, while allowing the current interruption section to be enhanced in high-voltage withstanding characteristics. It is also possible to provide a puffer type gas circuit breaker with improved mechanical reliability.

What is claimed is:

1. A puffer type gas circuit breaker comprising a movable arc contact provided within an envelope. filled with an arc-extinctive gas, a fixed arc contact opposing said movable arc contact, a puffer cylinder having a cylinder section and a shaft section, and a dielectric nozzle fixed to said puffer cylinder together with said movable arc contact for guiding the arc-extinctive gas to spray the gas between the arc contacts being opened and spaced apart from each other, wherein said movable arc contact and said fixed arc contact are disconnectable by operation of the shaft section of said puffer cylinder by way of an operating rod, wherein a guide section for performing radial guidance is provided at a coupling section disposed between said operating rod and said shaft section, and wherein said coupling section is coupled by a guide pin which is guided by said guide section, said coupling section being guided by said guide section in an axial direction of said guide pin.

2. The puffer type gas circuit breaker according to claim 1, further including a rolling bearing provided between said coupling section and said guide section.

3. The puffer type gas circuit breaker according to claim 1, further including a dielectric member provided between said coupling section and said guide section.

4. The puffer type gas circuit breaker according to claim 1, wherein said guide section is made of a dielectric material.

* * * * *